US007743715B2

(12) United States Patent
Becker et al.

(10) Patent No.: US 7,743,715 B2
(45) Date of Patent: Jun. 29, 2010

(54) AIR FLOW DIRECTION IN A TEMPERATURE CONTROLLED RAILROAD FREIGHT CAR

(75) Inventors: Bruce D. Becker, Vancouver, WA (US); Deborah V. Pence, Corvallis, OR (US)

(73) Assignees: Gunderson LLC, Portland, OR (US); The State of Oregon, on behalf of Oregon State University, Corvallis, OR (US)

( * ) Notice: Subject to any disclaimer, the term of this patent is extended or adjusted under 35 U.S.C. 154(b) by 670 days.

(21) Appl. No.: 11/596,386

(22) PCT Filed: May 13, 2004

(86) PCT No.: PCT/US2004/015213

§ 371 (c)(1),
(2), (4) Date: Jun. 28, 2007

(87) PCT Pub. No.: WO2005/113311

PCT Pub. Date: Dec. 1, 2005

(65) Prior Publication Data

US 2007/0289478 A1 Dec. 20, 2007

(51) Int. Cl.
*B61D 17/00* (2006.01)

(52) U.S. Cl. ..... 105/404

(58) Field of Classification Search ..... 105/355, 105/396, 397, 401, 404, 409
See application file for complete search history.

(56) References Cited

U.S. PATENT DOCUMENTS

| | | | | |
|---|---|---|---|---|
| 3,899,981 | A | 8/1975 | Josephson | |
| 4,091,743 | A | 5/1978 | Lemon | |
| 4,441,333 | A | 4/1984 | Mayer | |
| 5,855,174 | A | 1/1999 | Thoman | |
| 6,138,580 | A | 10/2000 | Thoman | |
| 6,321,661 | B1 | 11/2001 | Basile | |
| 6,422,156 | B1 | 7/2002 | Winsor | |
| 6,722,287 | B2 * | 4/2004 | Norton et al. | 105/404 |

* cited by examiner

*Primary Examiner*—S. Joseph Morano
*Assistant Examiner*—Robert J McCarry, Jr.
(74) *Attorney, Agent, or Firm*—Chernoff, Vilhauer, McClung & Stenzel, LLP

(57) ABSTRACT

An air flow conduit (98) and a related plenum (80) for distributing conditioned air from a refrigeration and heating unit (64) on an end (44) of a railroad freight car (20) into a cargo space (53) within the car (20). A deflector directs a flow of air upward into an inlet end of the plenum (80) and allows the flow to expand gradually within the plenum, smoothing the flow of air within the plenum so that it continues effectively at sufficient rates over the length of the car (20).

7 Claims, 12 Drawing Sheets

AIR FLOW DIRECTION IN A TEMPERATURE CONTROLLED RAILROAD FREIGHT CAR

BACKGROUND OF THE INVENTION

The present application relates to temperature controlled railroad freight cars, and particularly to railroad freight car body structures incorporating air duct arrangements for circulation of air from a refrigeration or heating unit to various locations within a body of such a car while maximizing available cargo space.

Temperature controlled railroad boxcars are well known, and have long used mechanical refrigeration and heating units mounted on an end wall, primarily to deliver chilled air to the interior of the car. For simplicity, the term refrigeration unit will be used herein to refer to refrigeration units, heating units, or units capable of both heating and cooling. Air from a refrigeration unit is typically forced into one end of an upper plenum extending longitudinally overhead, near the roof of the car, to deliver the conditioned air throughout the car to maintain a desired temperature throughout the cargo space in the car body. Such plenums in the past have intruded down into otherwise useable cargo space more than is desired, in order to assure sufficient air flow throughout the car body. This downward projection has also made the plenum vulnerable to damage from lift trucks moving cargo within such cars.

Typically, an air circulation pattern in such a temperature-controlled car includes flow of air down from the upper plenum onto and along the sides of the cargo and the end wall of the car that is remote from the refrigeration and heating unit. Air returns along the floor to a return air intake plenum leading back up along the near end wall to the refrigeration unit.

As railroad car sizes have increased it has become increasingly difficult to ensure even distribution of air throughout a railroad freight car, as needed in order to avoid uneven cooling that could damage parts of a sensitive cargo. A factor contributing to such difficulty is the desire to provide as much useable cargo space as possible within a boxcar whose size is limited by clearance along rights-of-way where the car is intended to be used.

Another factor in the design of such railcars is the need to avoid excessive car weight, which would limit the weight of cargo that could be carried and add to the cost of fuel used in hauling the car.

In view of these factors, it is desired to provide the necessary air circulation flow and distribution through an upper plenum that is no larger than necessary, so that it takes as little as possible of the potential cargo space within a refrigerated boxcar body, is out of the way of lift truck uprights and the like, and is not unnecessarily heavy.

Along with larger cars has come the desire to use larger lift trucks to quickly load and unload such cars. Lift trucks now in such use are rated at up to 60,000 lb (27240 kilograms) per axle. It is therefore also desired to provide for such a car a floor structure that provides sufficient strength and aids efficient air circulation and thermal conduction to or from the cargo, and yet does not contribute excessive weight to the car.

SUMMARY OF THE INVENTION

The present invention provides an answer to the aforementioned need for improved distribution of conditioned air within the cargo space of a temperature-controlled railroad freight car, as defined by the claims which follow.

In particular, in one preferred embodiment of the present invention an air outlet port from a refrigeration unit extends through an opening in an end wall of a railroad freight car body at a distance beneath a ceiling height and is interconnected with an inflow end of an upper plenum extending closely along the ceiling toward an opposite end wall of the car body. A diverter extends slopingly upward, from a location near a lower side of the air outlet port of the refrigeration unit, into the inflow end of the plenum, smoothly directing a flow of air from the outlet port of the refrigeration unit into the inflow end of the upper plenum. The diverter preferably includes an upper shoulder located at the inflow end of the upper plenum, defining a most constricted part of a path for the flow of air from the refrigeration unit, and an inner margin portion of the diverter extends away from the shoulder at a gently sloping angle, allowing the flow of air to expand slightly as it enters into the inflow end of the plenum.

In a preferred embodiment of the invention, an upper deflector is also included and provides a smoothly curved concave surface defining part of the path for the flow of air. The upper deflector extends from an end wall of the car, adjacent the inlet opening, to an upper interior surface of the upper plenum, and also contributes to smooth flow of air from the refrigeration unit into the plenum.

Smooth flow of air from the refrigeration unit into the upper plenum, combined with a smooth substantially unobstructed interior shape of the upper plenum, contributes to continued smooth flow of air throughout the upper plenum over the length of the temperature-controlled car, even in a car considerably longer than previously known refrigerated cars.

The foregoing and other features of the present invention will be more readily understood upon consideration of the following detailed description of the invention taken in conjunction with the accompanying drawings.

DETAILED DESCRIPTION OF THE PREFERRED EMBODIMENTS

Figure 1:
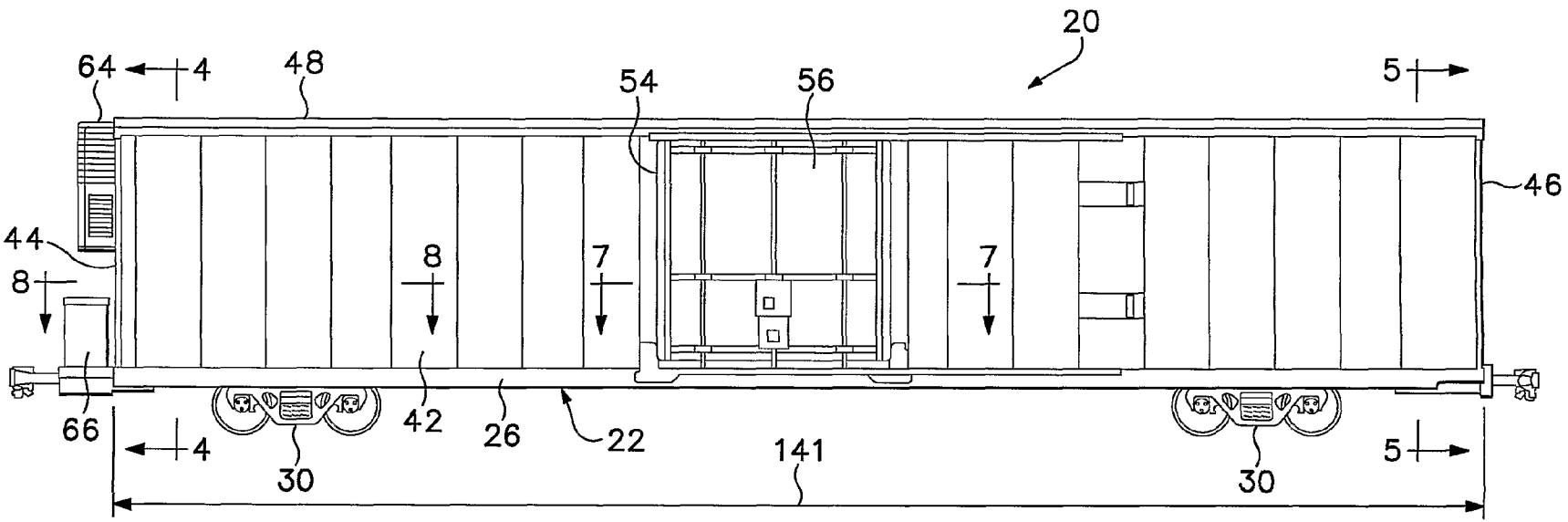
FIG. 1 is a side elevational view of a temperature controlled railroad boxcar which includes one preferred embodiment of the present invention.

Referring now to FIGS. 1-8 of the drawings which form a part of the disclosure herein, a temperature-controlled railroad freight car 20 has an underframe structure 22 which may include a center sill 24, a pair of side sills 26, and a pair of body bolsters 28 each supported by a wheeled truck 30. Cross-bearers 32 extend from the center sill to each of the side sills 26, and crossties 34, of lighter construction, extend similarly at spaced-apart locations between those of the body bolsters 28 and cross-bearers 32. Longitudinal stringers 36 are spaced apart between the side sills 26 and center sill 24 and are carried by the bolsters 28, cross-bearers 32 and crossties 34, assisting in supporting a subfloor 38 and a floor 40 that rests on the subfloor 38. An end sill 41 is located at each end of the car body, interconnecting the opposite side sills 26 that extend the entire length of the car between the end sills.

Side walls 42 and end walls 44 and 46 are supported by the underframe and extend upwardly above the floor 40 to a roof 48. The subfloor 38, end walls 44, 46, side walls 42, and roof 48 are of a thermally insulating construction. The floor 40, inner faces of the side walls and end walls, a ceiling 50, and an upper plenum 52 suspended beneath the ceiling 50, define an enclosed cargo space 53. Doorway openings 54 are provided in the side walls 42, and may be closed by conventional insulated doors 56. Construction of the side walls 42 and floor 40 may be largely conventional, in connection with one aspect of the car 20.

Preferably, as may be seen with reference also to FIGS. 2, 3, 4 and 5, the roof 48 of the car may be of composite construction, including a skin sheet 57 of corrugated sheet steel, for example 13 gauge steel panels pressed to the desired shape and welded together, and which is preferably cambered to promote runoff of precipitation. A layer 58 of thermal insulation material such as a closed cell plastic foam is fastened to the skin sheet 57 and may have a depth 60 of about six inches (7.6 cm), below which smooth ceiling panels 62 of fiber reinforced plastic are located.

In a preferred embodiment of the temperature-controlled railcar 20, the roof 48 is manufactured as an assembly of composite materials that can be placed atop and fastened to the end walls 44, 46 and side walls 42 as a single module during the process of assembling the car 20. A fiber-reinforced polymeric resin liner including the substantially flat ceiling panels 62 of fiber reinforced plastic is attached to the skin 57 to form an enclosed space between the skin 57 and the liner. That space is filled with poured-in-place urethane foam insulation and cured, with the roof 48 assembly held in a suitable press to maintain the required shape.

A refrigeration unit 64 is mounted on the outer side of the end wall 44 at an "A" end of the car, and a fuel tank 66 for the refrigeration unit 64 may be supported by the underframe 22 of the car beneath the refrigeration unit.

A refrigeration unit opening 68 is provided in the "A" end wall 44 to receive an inwardly directed portion of the refrigeration unit 64 and to permit air from within the cargo space 53 to enter into the refrigeration unit 64 through a lower portion of the refrigeration unit opening 68, to be chilled or heated as may be needed, and to allow the refrigerated (or heated) air from the refrigeration unit 64 to be delivered into the car for distribution as necessary within the cargo space 53. The top 70 of the refrigeration unit opening 68 is spaced downward a distance 72 such as 1 inch (2.5 cm) beneath the height of the ceiling 50. The refrigeration unit opening 68 may have a height 74 of 46 inches (116.8 cm), for example, in order to accommodate any of various commercially available refrigeration units.

An upper, or air inlet opening portion 76 of the refrigeration unit opening 68 extends down to the structure of the top 78 of a return air plenum 80 extending up from the floor 40 along the interior of the end wall 44. Air can return through the return air plenum 80 to the supply air opening 82 or intake of the refrigeration unit 64. The upper or air inlet opening portion 76 of the refrigeration unit opening 68, above the top 78 of the return air plenum 80, receives the air outlet port 84 of the refrigeration unit, from which a flow of air proceeds toward the interior of the cargo space 53 within the car body 20. The air outlet port 84 is defined by the refrigeration unit 64 and may have, for example, a height 86 of 4⅞ inches (11.9 cm) and a width 88 of 30 13/16 inches (78.1 cm) in a refrigeration unit available from the Carrier Corporation.

Figure 2:
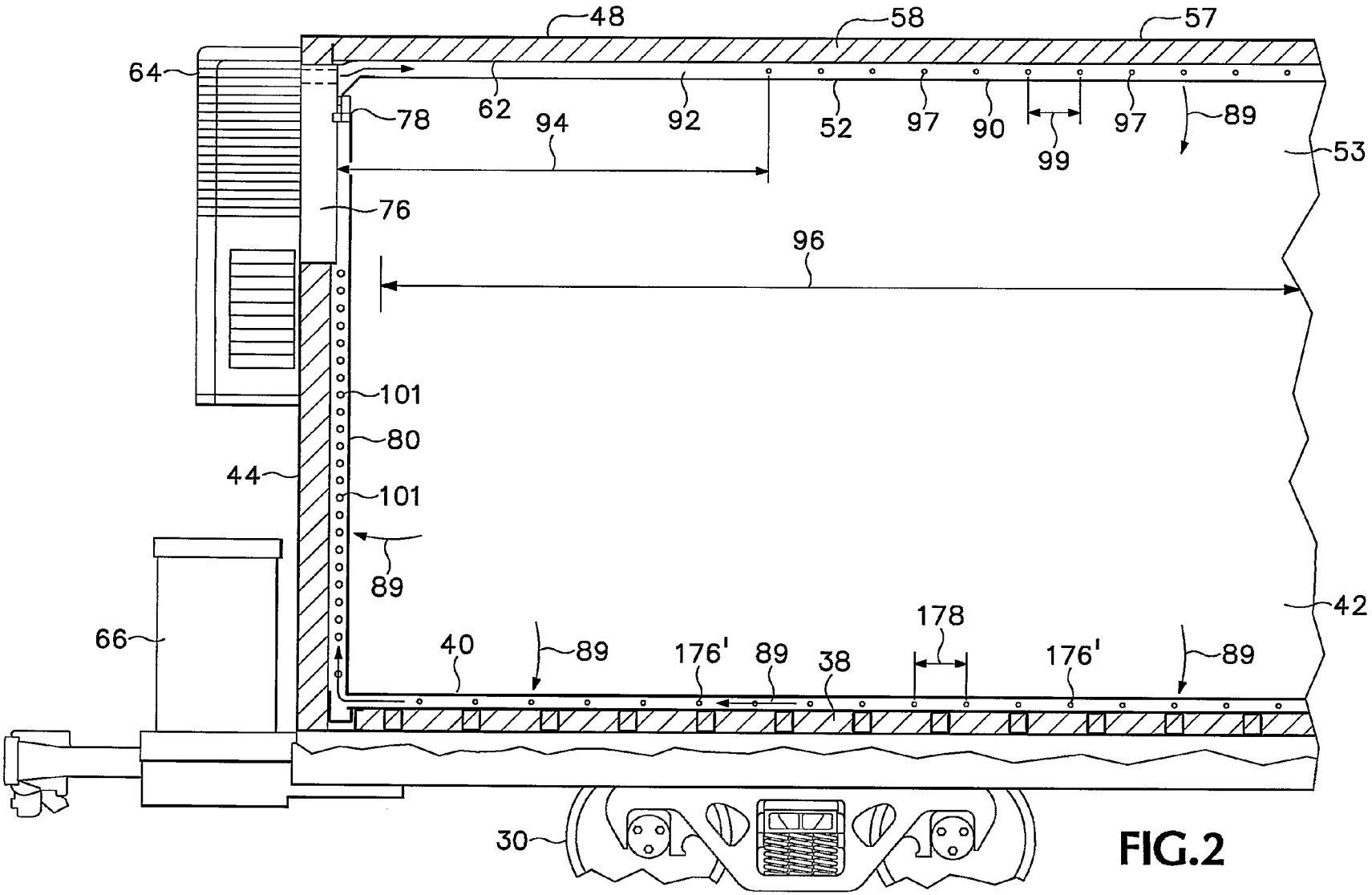
FIG. 2 is a side elevational view of a portion near a first end of the car shown in FIG. 1, with the near side cut away to expose the interior of the car, showing a part of a pattern of flow of air from the refrigeration unit to the cargo space within the car and back to the refrigeration unit.
Figure 3:
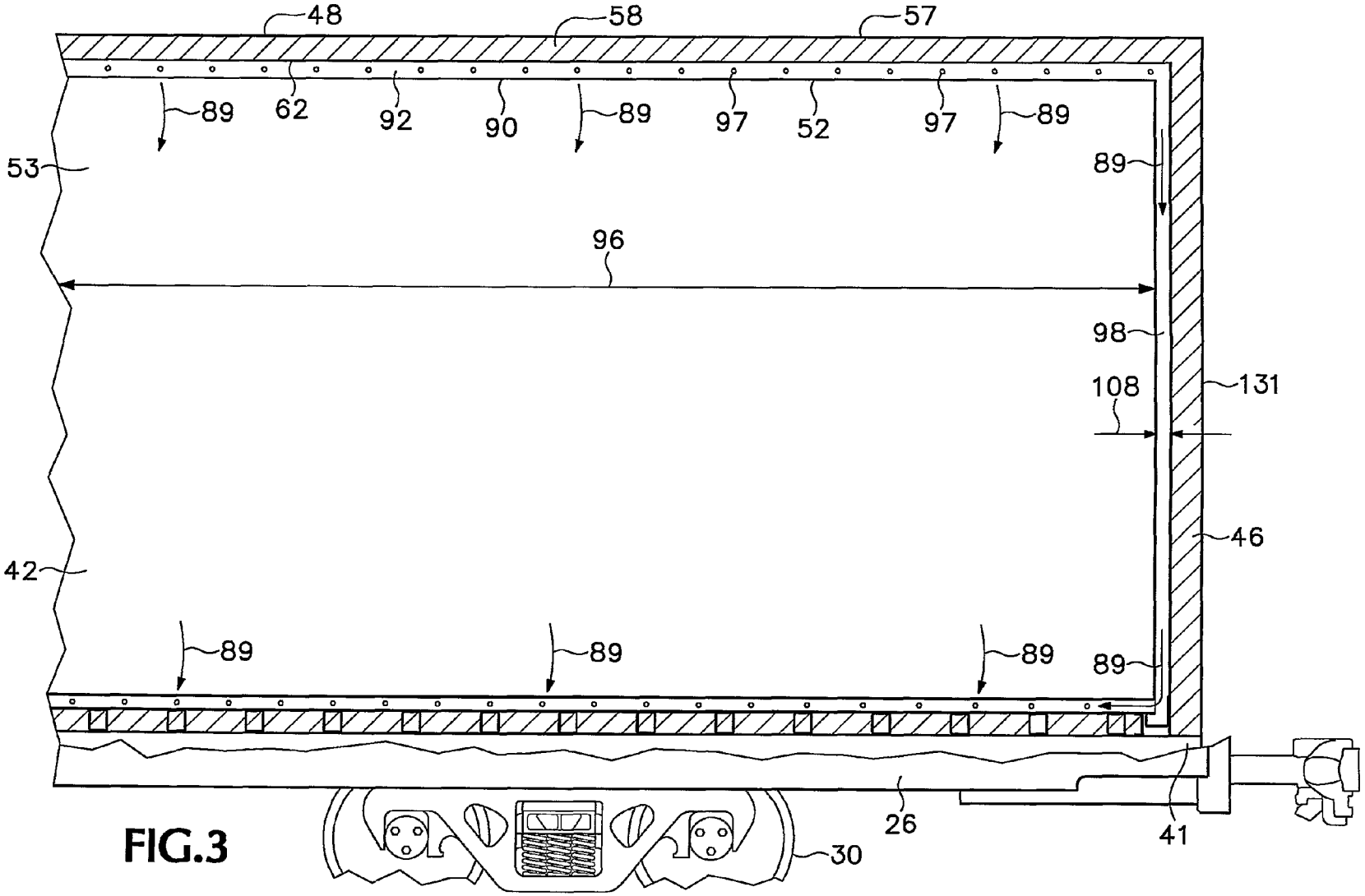
FIG. 3 is a side elevational view of a portion near the other end of the car shown in FIG. 1, with the near side cut away to expose the interior of the car, showing another part of the pattern of flow of air from the refrigeration unit to the cargo space within the car and back to the refrigeration unit.
Figure 4:
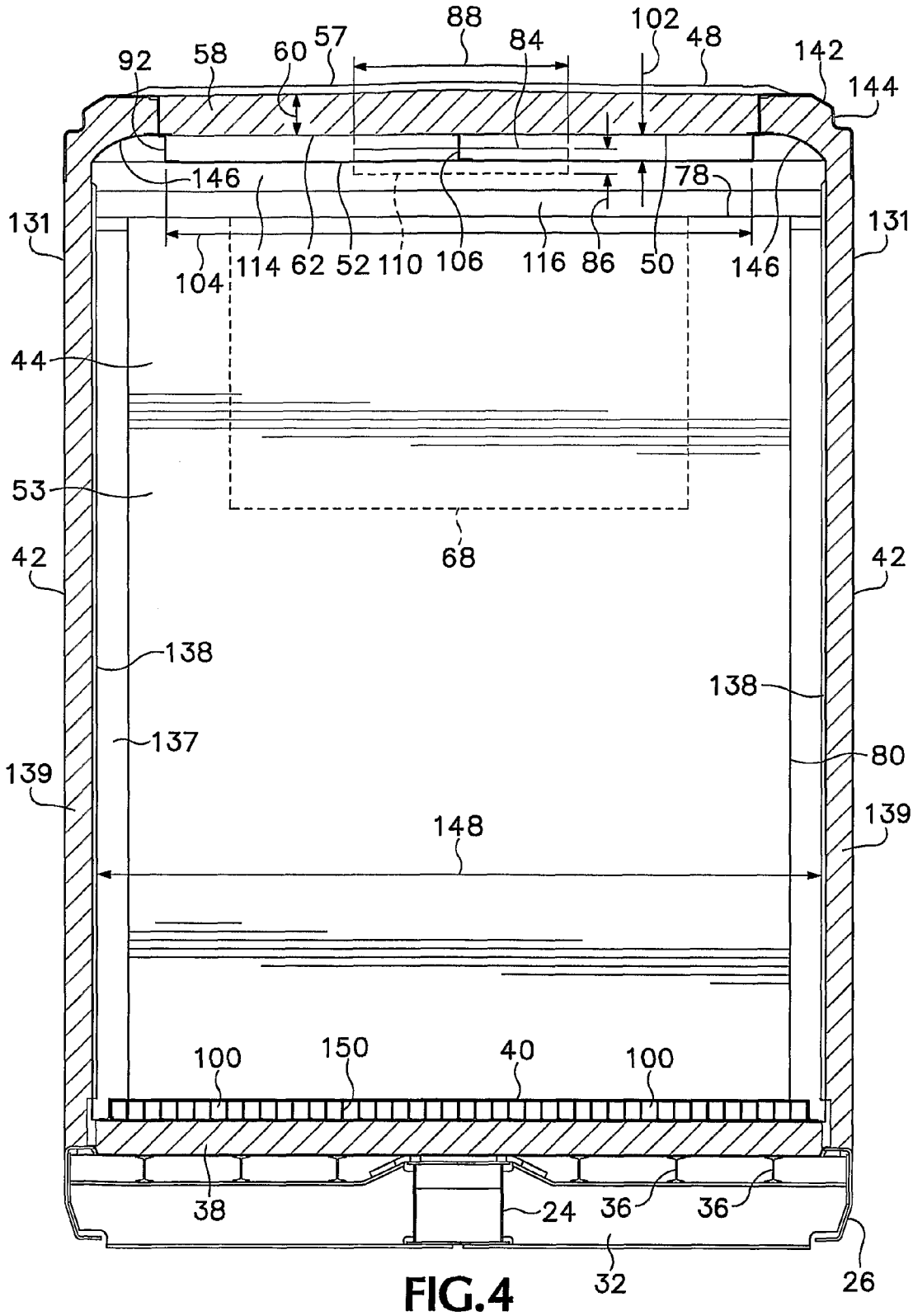
FIG. 4 is a sectional view toward a first, or "A" end of the car, taken along line 4-4 of FIG. 1.
Figure 6:
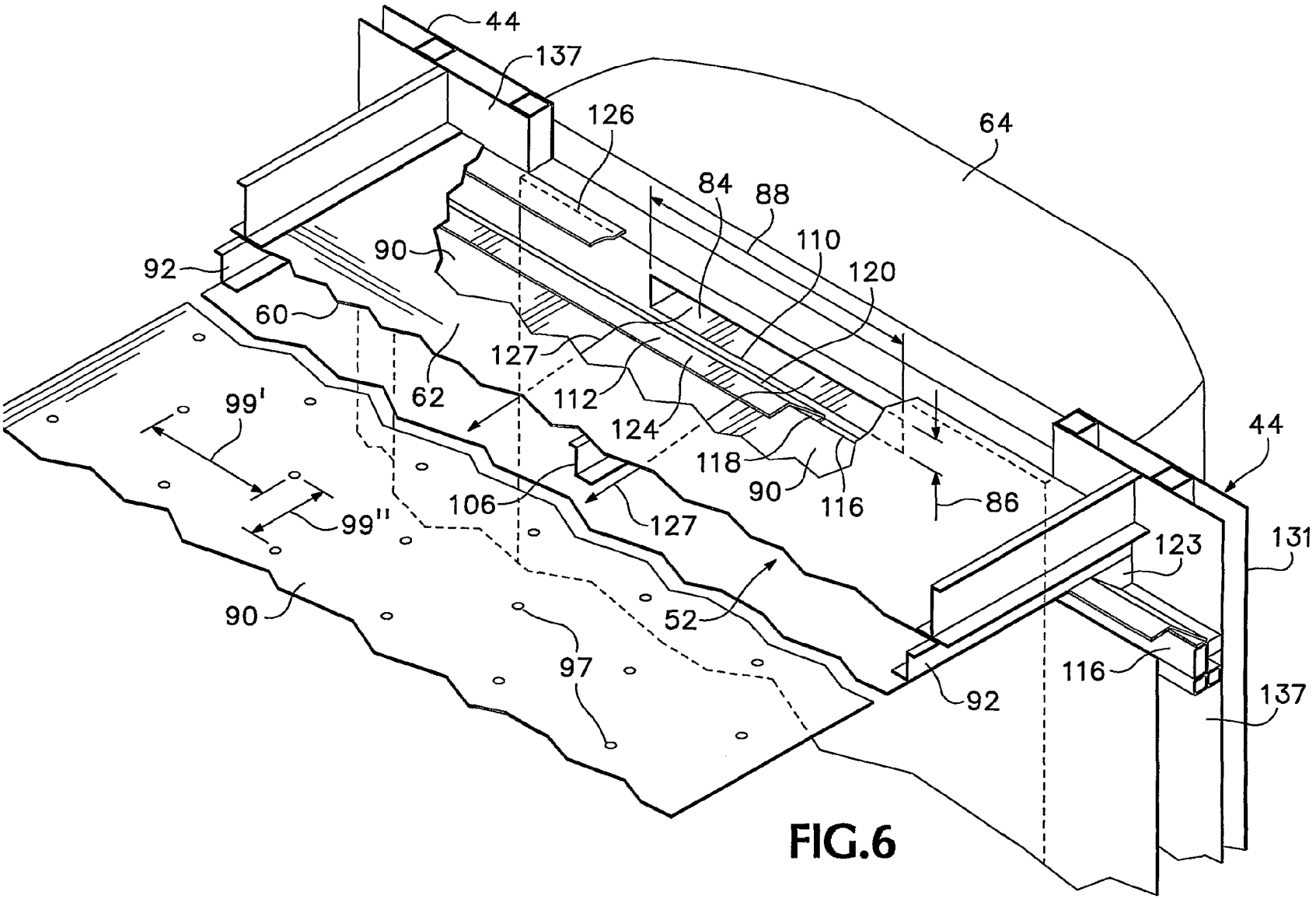
FIG. 6 is an isometric view from a point above and to one side of the car shown in FIG. 1, and looking toward the "A" end of the car, showing a preferred arrangement of a plenum adjacent the ceiling of the car and an air discharge port for a refrigeration unit carried on the "A" end of the car.
Figure 7:
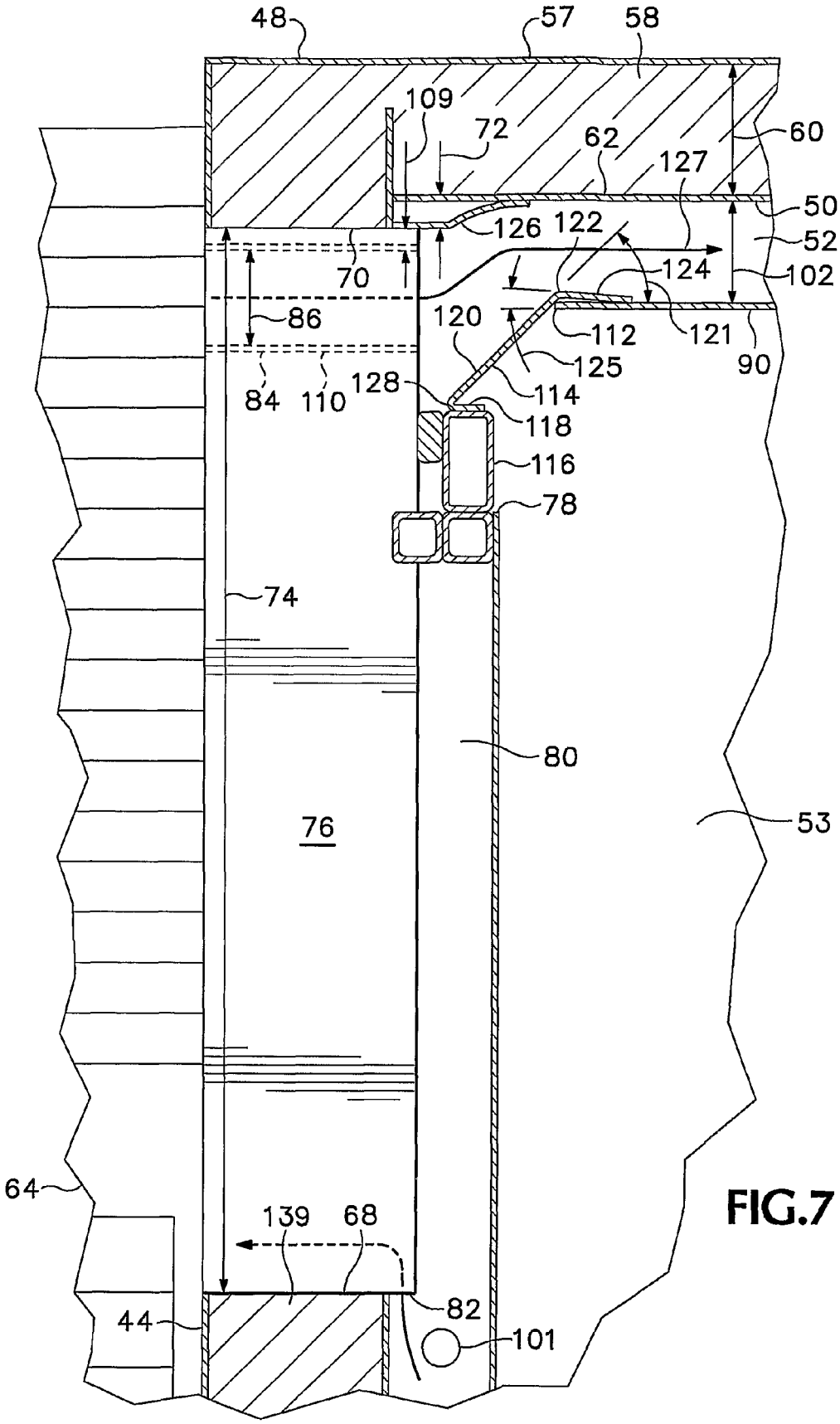
FIG. 7 is a view of a portion of FIG. 2 at an enlarged scale, showing details of the inflow end of the upper plenum and associated structures.

A general pattern of air circulation is shown by the arrows 89 in FIGS. 2, 3, 6, and 7. The upper plenum 52 extends along the underside of the ceiling 50 from a location adjacent the "A" end wall 44 of the car toward the opposite, or "B", end wall 46 of the car. Bottom panels 90 and side panels 92 of the upper plenum 52 are perforated, beginning from a point a predetermined distance 94, such as 8 feet, from the "A" end wall and thence along the length 96 of the upper plenum 52 to a location near the "B" end wall 46. Perforations may be circular holes 1 inch (2.5 cm) in diameter arranged in line with center-to-center spacings 99 of 6 inches (15.2 cm) in the side panels 92, as shown in FIG. 2, in one preferred embodiment. In the plenum bottom panel 90, the holes 97 may be arranged in staggered transversely extending rows with holes spaced apart by a distance 99' of about 14¾ inches (37.5 cm) in a row and with rows spaced apart by a distance 99" of about 18 inches (45.7 cm), as shown in FIG. 6, to allow air to escape from the upper plenum 52 in an evenly distributed fashion.

A conduit 98 extends downwardly along the interior side of the "B" end wall 46 toward the floor 40, and passageways 100 are defined longitudinally through the floor 40 toward the "A" end beneath cargo (not shown) that may be resting on the floor 40, to complete a circulation route for air, collecting and leading the flow of air back toward the "A" end of the car body after it has absorbed heat from the cargo and from the ceiling 50, walls 42, 44, and 46, and floor 40. The return flow of air through the floor 40 makes that air available near the "A" end of the car 20 to be drawn into the refrigeration unit 64 and again chilled for circulation again within the cargo space. Air which has escaped from the upper plenum 52 through the perforations described above flows over the upper surfaces and along the side surfaces of cargo contained in the cargo space 53, and is then conducted forward within the car, along the floor 40 and at least partially through the air passageways 100, toward the "A" end. The return air plenum 80 receives the forward-flowing air from the passageways 100, or through openings 101 in the sides of the return air plenum 80, and conducts it into the supply air, or intake, opening 82 of the refrigeration unit.

The ceiling 50 is preferably adhesively attached to the underside of the roof 48 as an integral part thereof, and is preferably constructed of generally flat horizontal panels 62 of fiber reinforced polymeric resin, which can be amply stiff, are of lighter weight than previously utilized metal ceiling panels, and can be interconnected with each other in smooth joints, providing a generally smooth and flat ceiling surface as the upper interior surface of the upper plenum 52.

The bottom panels 90 of the upper plenum 52 are similarly flat and located parallel with the ceiling panels 62, providing a wide plenum with smooth interior surfaces and a smaller height than that of similarly located plenums in previously known cars. The height 102 of the upper plenum 52 is preferably less than 4 inches (10.2 cm) and more preferably is about 3 15/16 inches (10.0 cm), while the width 104 of the upper plenum 52 is preferably relatively great, to spread the flow of air over the width of the cargo space, and may, for example, be about 88 13/16 inches (225.6 cm).

In a preferred embodiment of the upper plenum 52, the bottom panels 90 of the plenum are of a stiff fiber reinforced resin sheet material having a nominal thickness of 0.075 inch (0.19 cm) and the sides 92 of the upper plenum 52 are of easily flexible urethane resin sheet material adhesively attached to the ceiling 50 and the plenum bottom panels 90. A central support web or a plurality of small support strips 106 of similar flexible material may be used to support the median portions of the plenum bottom panels 90, although the plenum bottom panels 90 are preferably rigid enough to be largely self supporting and remain substantially flat and parallel with the ceiling 50. The flexibility of the plenum sides 92 and support strips 106 permits the bottom panels 90 simply to move up if bumped by a lift truck or cargo during loading or unloading of the car, and to move back down into place undamaged when the offending item has been removed. The car 20 may be constructed to provide an interior height of 11 feet, 9 inches (3.58 m) between the floor 40 and the upper plenum 52, while remaining within the limitations of AAR Plate F and providing acceptable thermal insulation.

Figure 5:
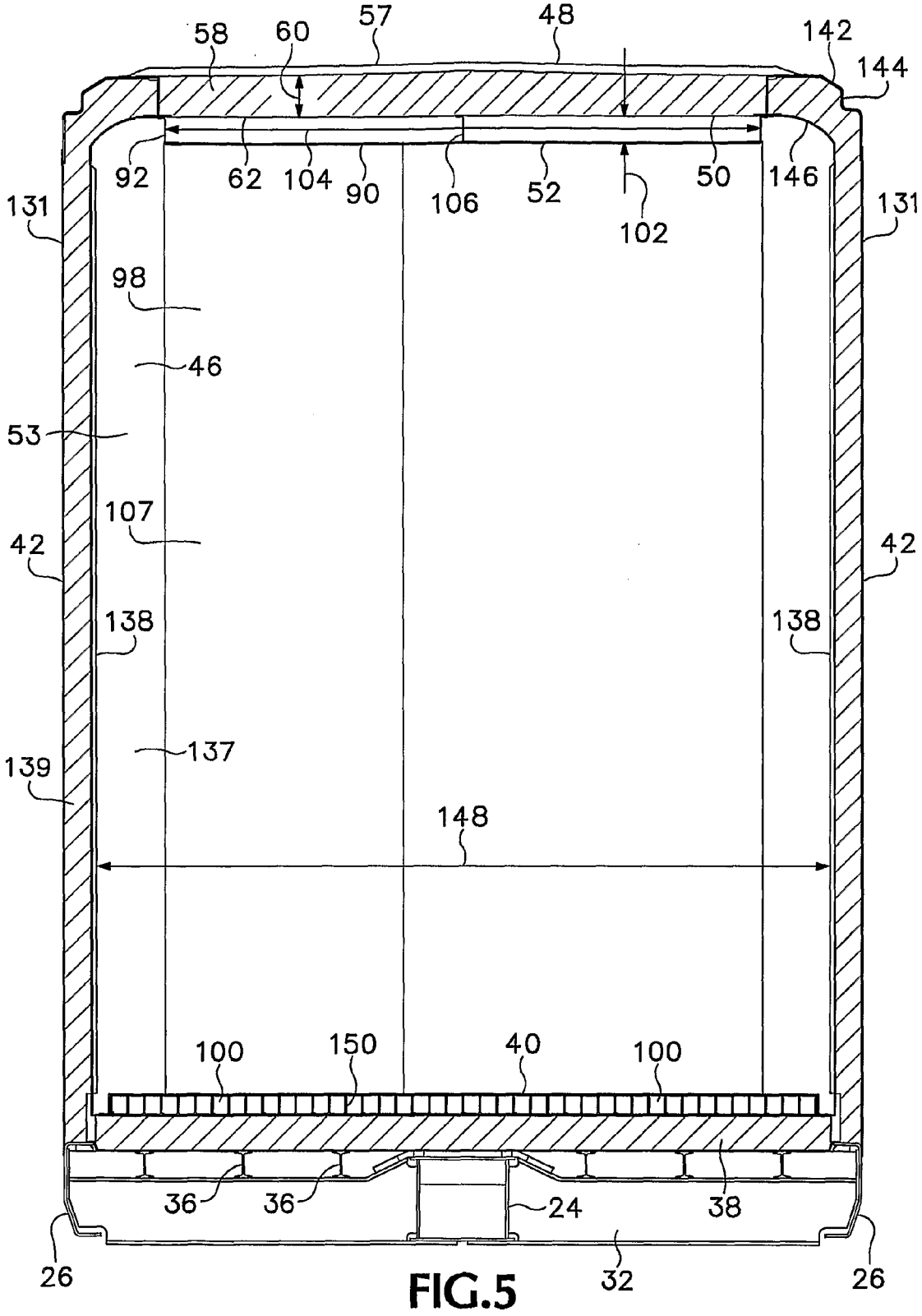
FIG. 5 is a sectional view toward a second, or "B" end of the car, taken along line 5-5 of FIG. 1.

The conduit 98 defined along the "B" end wall 46 for downward flow of air has a cross sectional area which is smaller than that of the interior of the upper plenum. While the conduit 98, as shown in FIG. 5, extends across most of the width 148 of the "B" end wall 46, a vertical conduit wall 107 is spaced apart from the interior surface of the insulated "B" end wall of the car by a distance 108 of, for example, only 1½ inches (38 mm), which is about one-third the height 102 of the upper plenum 52 mentioned previously. The flow of air down through the conduit 98 along the interior face of the "B" end wall 46 is thus comparatively restricted, generating some back pressure against the flow of air through the upper plenum 52 and requiring some of the flow of air into the upper plenum 52 to flow out of the upper plenum 52 through the perforations in the sides 92 and bottom panels 90 of the upper plenum.

Nevertheless, in order for the air to be distributed as evenly as is necessary throughout the interior of the cargo space 53 within the car 20, it is desired for the flow of air through the upper plenum 52 to proceed unimpeded and smoothly toward the "B" end of the car.

Because of the location of the air outlet port 84 in the refrigeration unit 64, the top of the air outlet port 84 is spaced downward from the top 70 of the refrigeration unit opening 68 in the "A" end wall 44 of the car body by a distance 109 of about 2 inches (5.1 cm). Because the height 86 of the air outlet port 84 of the refrigeration unit 64 is greater than the height 102 of the upper plenum 52, the bottom 110 of the air outlet portion 84 is thus located at a distance below the ceiling 50 and also below the plenum bottom panel 90. In order to promote the desired smooth flow through the interior of the upper plenum 52, the flow of air from the air outlet port 84 through the end wall 44 at the "A" end of the car 20 must be diverted upward to the inflow end 112 of the upper plenum 52, but diversion must be accomplished without causing turbulence that would interfere with the flow of air through the interior of the upper plenum 52 toward the opposite, or "B", end of the car 20. Accordingly, a diverter 114 is mounted atop a transverse structural member 116 that extends across the width of the interior of the car at the top of the return air plenum 80 at the "A" end, as may be seen in FIGS. 4, 6, and 7.

A preferred embodiment of the diverter 114 includes a narrow base flange 118 mounted upon and attached to the transverse structural member 116 and extending away from the "A" end wall 44. An upwardly sloped front face portion 120 extends from the base flange 118 toward the ceiling 50 and away from the interior face of the end wall 44 at the "A" end, at an angle 121 preferably in the range of 40°-60° and most preferably equal to about 45° to the plenum bottom panel 90. An uppermost portion of the diverter 114, at the top of the front face portion 120, defines a shoulder 122, and beyond the shoulder 122 an inner margin portion 124 extends further away from the "A" end wall 44 into the inflow end 112 of the upper plenum 52, extending away from the shoulder 122 at a gentle downward slope, such as an angle 125 in the range of 3-6 degrees and preferably of about four degrees to the plenum bottom panel 90. The shoulder 122 and the inner margin portion 124 may be considered to be a flow transition portion of the diverter 114.

A flow of air from the outlet port 84 of the refrigeration unit 64 is forced to follow the sloping front face 120 of the diverter 114 upward to and through a most restricted area, or throat, near the inflow end 112 of the upper plenum 52, at the location of the shoulder 122. The available area for flow of air into the upper plenum 52 then expands gradually along the gently sloping inner margin portion 124 toward the interior of the upper plenum 52 and the "B" end of the car 20. A blocking panel 123 aligned with each side panel 92 seals the space above the diverter 114 to the upper plenum 52 at each side.

Preferably, in addition to the diverter 114 an upper deflector panel 126 is also provided and extends generally horizontally from the interior face of the "A" end wall toward the "B" end wall from the top of the refrigeration unit opening 68 defined through the "A" end wall 44, thus at a small distance beneath the ceiling 50, to a location approximately above the interior face of the refrigeration unit 64 and the lower, front margin 128 of the diverter 114. From that location, the upper deflector 126 extends arcuately upward and away from the "A" end wall 44 toward a location on the ceiling 50 at the inflow end 112 of the upper plenum 52, in a downwardly facing, concave shape, appearing in side view in FIGS. 2 and 7 as a partial cylinder. The upper deflector 126 thus aids in smoothly directing the flow of air from the outlet port 84 of the refrigeration unit 64 into the inflow end 112 of the upper plenum, and in gradually reducing the space available for the flow of air to a minimum located approximately at the location of the shoulder 122.

Both the diverter 114 and the upper deflector 126 may be of fiber reinforced plastic resin sheet material, in order to minimize the weight of the car 20.

As a result of the arrangement of the diverter 114 and upper deflector 126, the air from the refrigeration unit 64, which initially flows generally horizontally from the outlet port 84, is diverted upward by the sloping front face 120 of the diverter 114. The flow of air is shaped further by the concave lower face of the upper deflector 126, and is then redirected to a horizontal flow into the inflow end 112 of the upper plenum. The flow is slightly constricted by the shoulder 122 at the top of the forward face of the diverter 114 and is thereafter allowed to expand gradually as it accelerates and proceeds along the gently sloping inner margin portion 124 of the diverter 114 as shown by the arrow 127. The air thus moves smoothly in a suppressed turbulent state in a generally horizontal direction through the upper plenum 52 toward the "B" end of the car body as it leaves the diverter 114. This construction permits an interior length of the cargo space 53 of as much as 72 feet, 3 inches (22.02 m) between the conduit 98 at the "B" end and the return plenum 80 at the "A" end.

Since the upper plenum 52 is essentially airtight near the input end 112 and for a distance toward the "B" end of the car, until the pattern of perforation is encountered, a distance 94 of about 8 feet from the end wall 44 at the "A" end of the car 20, the flow of air continues within the upper plenum 52 toward a region of gradually decreasing pressure extending toward the "B" end, created as air is exhausted from the upper plenum 52 through the perforations along the sides 92 and bottom panel 90 of the upper plenum 52 to flow over and around cargo toward the floor 40. Because the interior surfaces of the plenum 52 are generally planar and smooth, rather than being obstructed by raised joints or ribs extending transversely across the upper plenum 52 to provide stiffness as in previously utilized ceiling panels and plenum panels, the smooth flow of air continues from the "A" end to the "B" end of the car body relatively free from turbulence.

Figure 8:
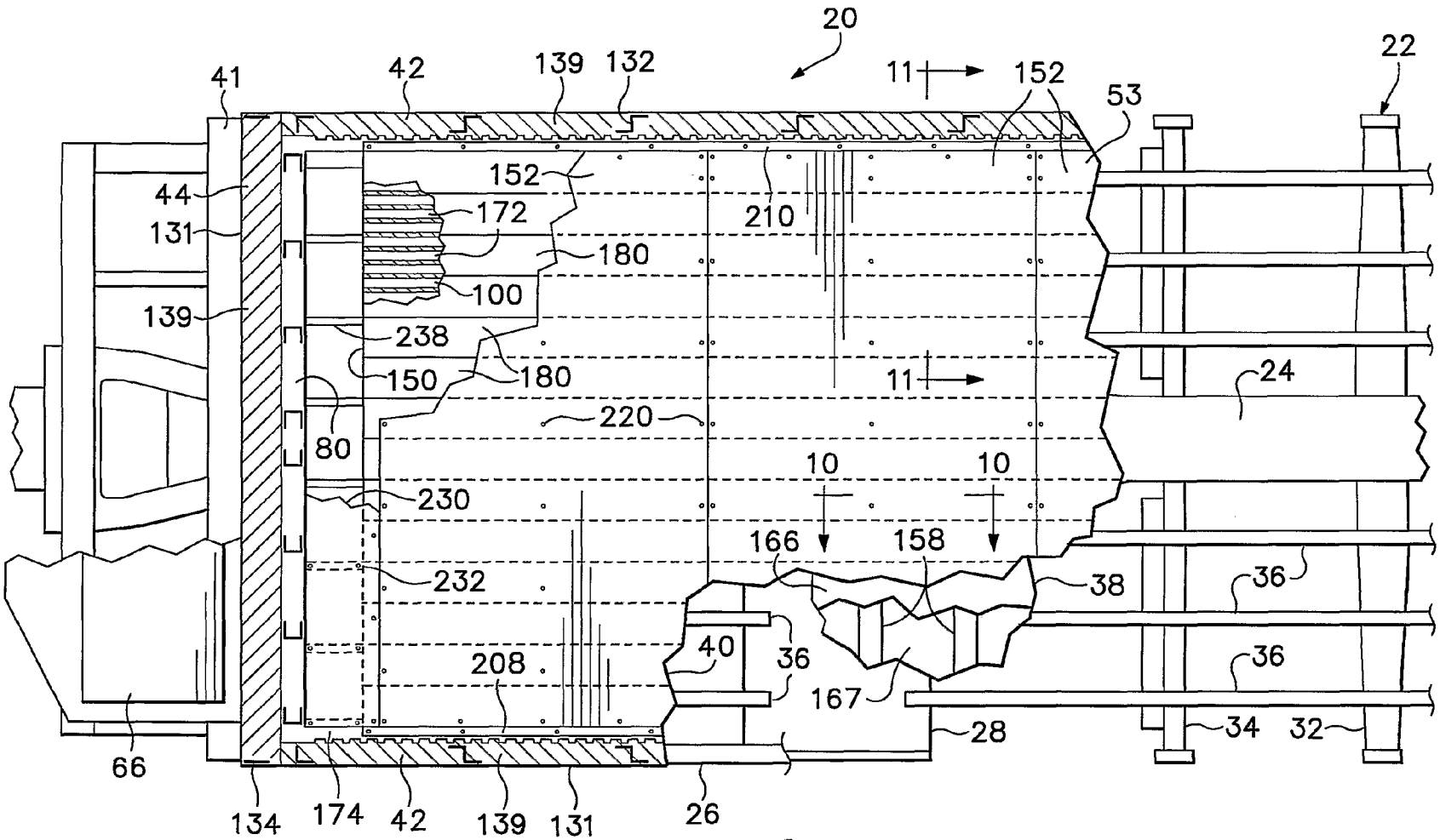
FIG. 8 is a partially cutaway sectional view, taken along line 8-8 in FIG. 1, showing a portion of the floor, subfloor, and subframe structures of the car.
Figure 9:
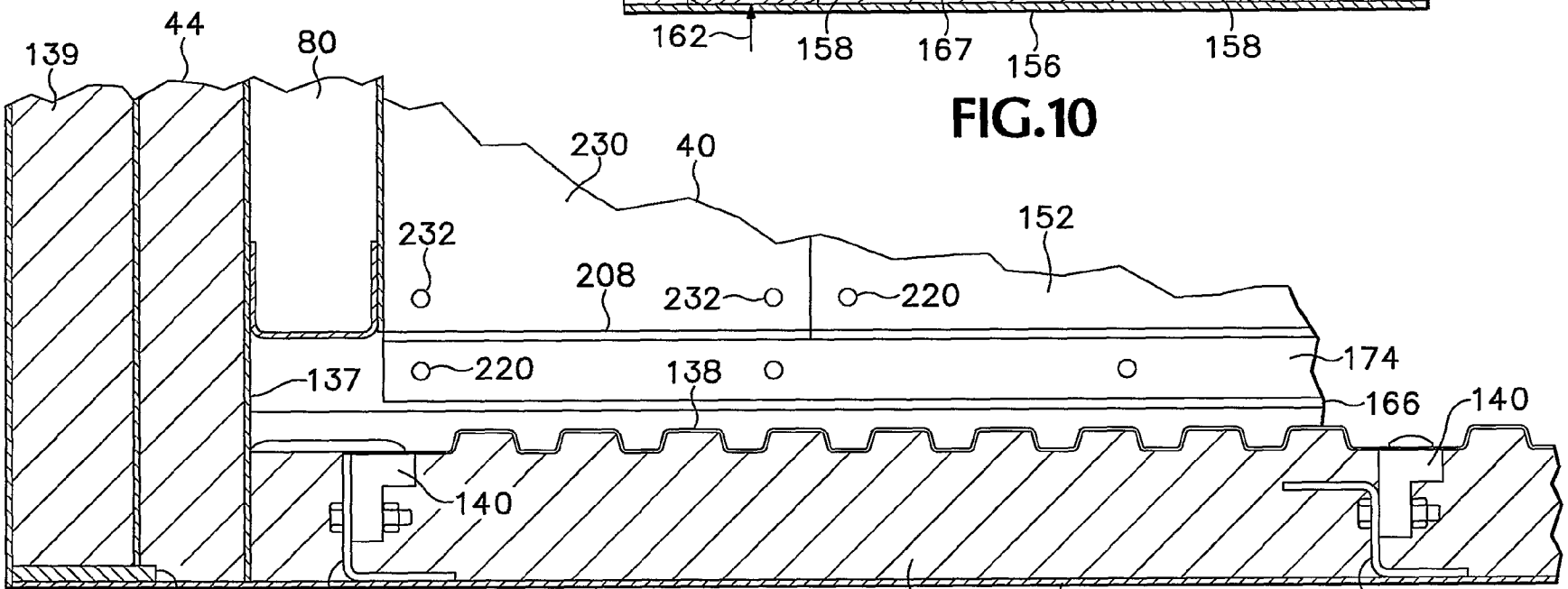
FIG. 9 is a view of a detail of FIG. 8 at an enlarged scale, showing construction of an end wall and a side wall.

Referring to FIGS. 8 and 9, each side wall 42 rests atop and extends upwardly from a respective one of the side sills 26, with a sheet steel outer skin sheet 131 supported by a plurality of upright side posts 132 spaced apart at intervals between corner posts 134. A doorway frame 136 is incorporated, and all of the side posts 132, corner posts 134 and doorway frame members 136 are securely fastened to the outer skin sheet 131 as by welding. The end walls 44 and 46 also include steel skin sheets 131 and extend upward to join the roof 48 at each end of the car 20. As an interior face of each side wall 42, corrugated fiber-reinforced plastic panels 138 are fastened, as by suitable adhesives or nails, to nailing strips 140 of non-metallic material fastened, as by bolts or other suitable fasteners, to each of the side wall posts 132. Flat interior panels 137 are mounted in the end walls 44 and 46. Spaces within the side walls 42, between the skin 131 and panels 138 are preferably filled with foamed-in-place insulating foam resin 139, such as closed cell urethane foam, and the spaces between the skin 131 and interior panels 137 of the end walls 44 and 46 are filled preferably with foam blocks.

At the top of each side wall 42 and extending longitudinally along the entire length 141 of the car body 20 is a top chord assembly 142 having an exterior structural layer 144 of sheet steel incorporating a horizontal leg, a downwardly angled diagonal leg, a small inwardly protruding L-shaped portion, and a downwardly extending leg that mates with and is parallel with outer sheet 131 of the side wall. The roof assembly 48 fits between the top chords 142 with the margins of the steel skin 57 of the roof extending above and along the horizontal portions of the top chord assemblies 142. An arcuate wall closure panel 146 extends from the top of the wall 42, 44, 46 on the interior of the car, to the ceiling panel 62 defining the bottom side of the roof structure 48, and the space between the wall closure panel 146 and the top chord outer structural member 144 is filled with insulating closed cell foam, preferably foamed in place.

The upper plenum 52 extends to the "B" end wall 46 of the car body with a uniform interior height 102 and is there interconnected to the vertical conduit 98, which carries the remainder of the air flow downward from the plenum 52 and along the interior face of the end wall 46 at the "B" end of the car body and connects the adjacent end of the upper plenum 52 to the end of the floor 40.

Figure 10:
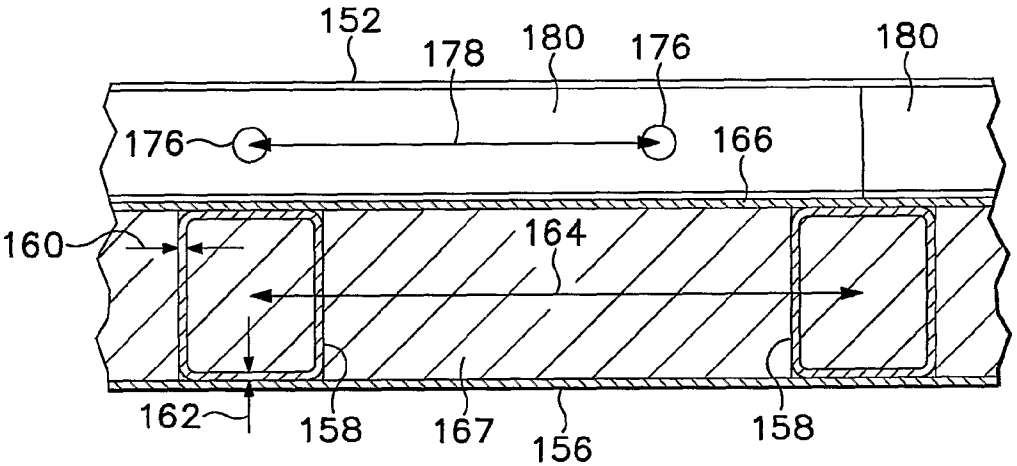
FIG. 10 is a sectional view, at an enlarged scale, taken along line 10-10 in FIG. 8, showing a portion of the structure of the subfloor and floor of the temperature-controlled car.

The floor 40, as shown also in FIGS. 10 and 11 is supported by the composite subfloor 38, and includes a weight bearing tubular support structure 150 resting on and fastened to the subfloor 38 and defining the longitudinally extending parallel air pathways 100. The tubular support structure 150 is unified and covered by a set of floor plates 152 connected to and extending over the entire length and width of the assembled tubular support structure 150.

As mentioned briefly above, the underframe of the car is preferably of welded steel construction. The stringers 36, which may be steel I-beams, rest atop the transversely extending cross-bearers 32 and crossties 34, and extend longitudinally, spaced apart from each other and parallel with the side sills 26 and center sill 24, between the body bolsters 28 and between each body bolster 28 and the nearby end sill 41. Preferably the stringers 36, body bolsters 28, and center sill 24 all include generally horizontal top surfaces that are all substantially coplanar, and the subfloor 38, preferably of composite construction, rests atop those coplanar surfaces.

In a preferred construction of the car body, the composite subfloor 38 includes a bottom panel 156 of fiber reinforced plastic resin, 0.1 inch (2.5 mm) thick, for example, and extends horizontally and rests atop the stringers 36 and center sill 24, attached to their coplanar horizontal top surfaces by a suitable adhesive, such as Normount V2800 bonding tape.

The bottom panel 156 of the subfloor 38 rests on an upwardly offset outwardly extending steel sheet margin mount 157 which rests atop upper flanges of the side sills 26, as shown in FIG. 11. Rectangular support tubes 158 of fiber reinforced plastic, preferably about 5 inches (12.7 cm) high and 4 inches (10.2 cm) wide, with tube sidewall thickness 160 of ⅜ inch (9.5 mm) and top and bottom wall thicknesses 162 of ¼ inch (6.4 mm) extend transversely, across the width 148 of the car body, establishing a vertical spacing distance between the bottom panel 156 and top panels 166 of similar fiber-reinforced plastic resin material. The tubes 158 are spaced evenly apart from one another along the length of the interior of the car body, with a regular spacing 164 of, for example, eighteen inches (45.7 cm) center-to-center. The tubes 158 are filled preferably with closed cell polymeric resin foam, for example, a urethane foam having a density of $1.16\times10^{-3}$ lb/in.$^3$ (0.032 g./cm$^3$). The spaces between the tubes 158 are occupied by closed cell resin foam insulating material preferably having a similar density and preferably installed in the form of urethane foam blocks 167.

The fiber-reinforced plastic top panels 166 rest atop the rectangular tubes 158 and foam blocks 167 and are fastened to the rectangular tubes by adhesive bonding tape, such as Ashland Chemical 8000/6660. Each top panel 166 preferably extends the full width 148 of the interior of the car body and extends longitudinally a distance equal to a multiple of the spacing 164 of the transversely extending support tubes 158, except for a smaller panel at each end of the car body, where the floor 40 and subfloor 38 would never be subjected to as great a weight loading as where a lift truck can be located inside the car 20. At the base of each side wall 92, flexible elastic filler and seal members 168, seen best in FIG. 11*b*, are provided between a plastic resin spacer 169 at the base of the side wall 42 and the adjacent margins of the subfloor 38.

Figure 11A:
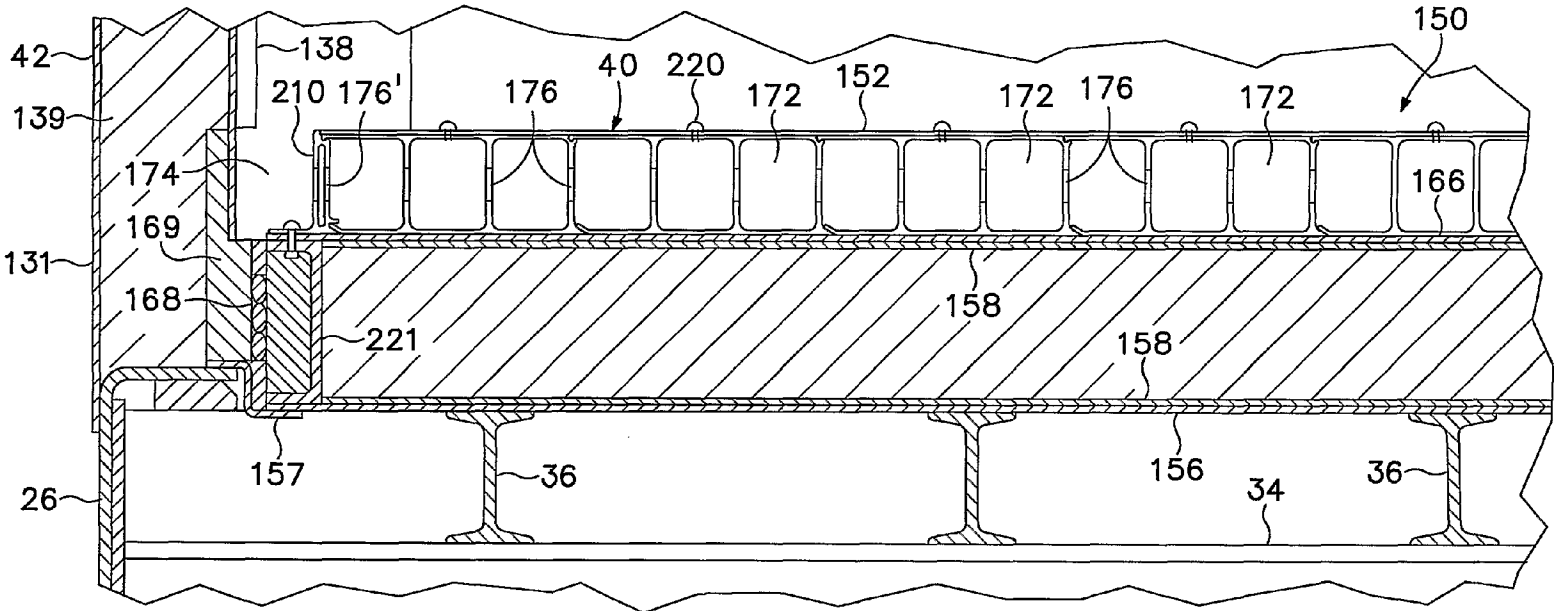
FIG. 11*a* is a sectional view taken along 11-11 in FIG. 8 at an enlarged scale, showing the construction of the floor and subfloor of the car.
Figure 12:
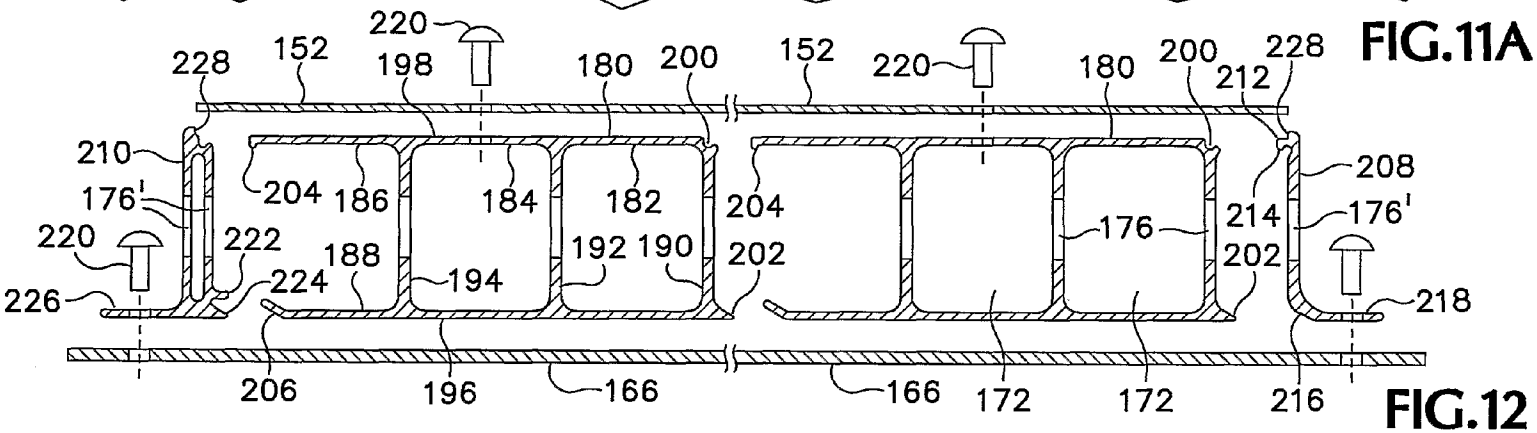
FIG. 12 is an exploded view, at an enlarged scale, of portions of the extruded aluminum floor shown in FIG. 11.
Figure 11B:
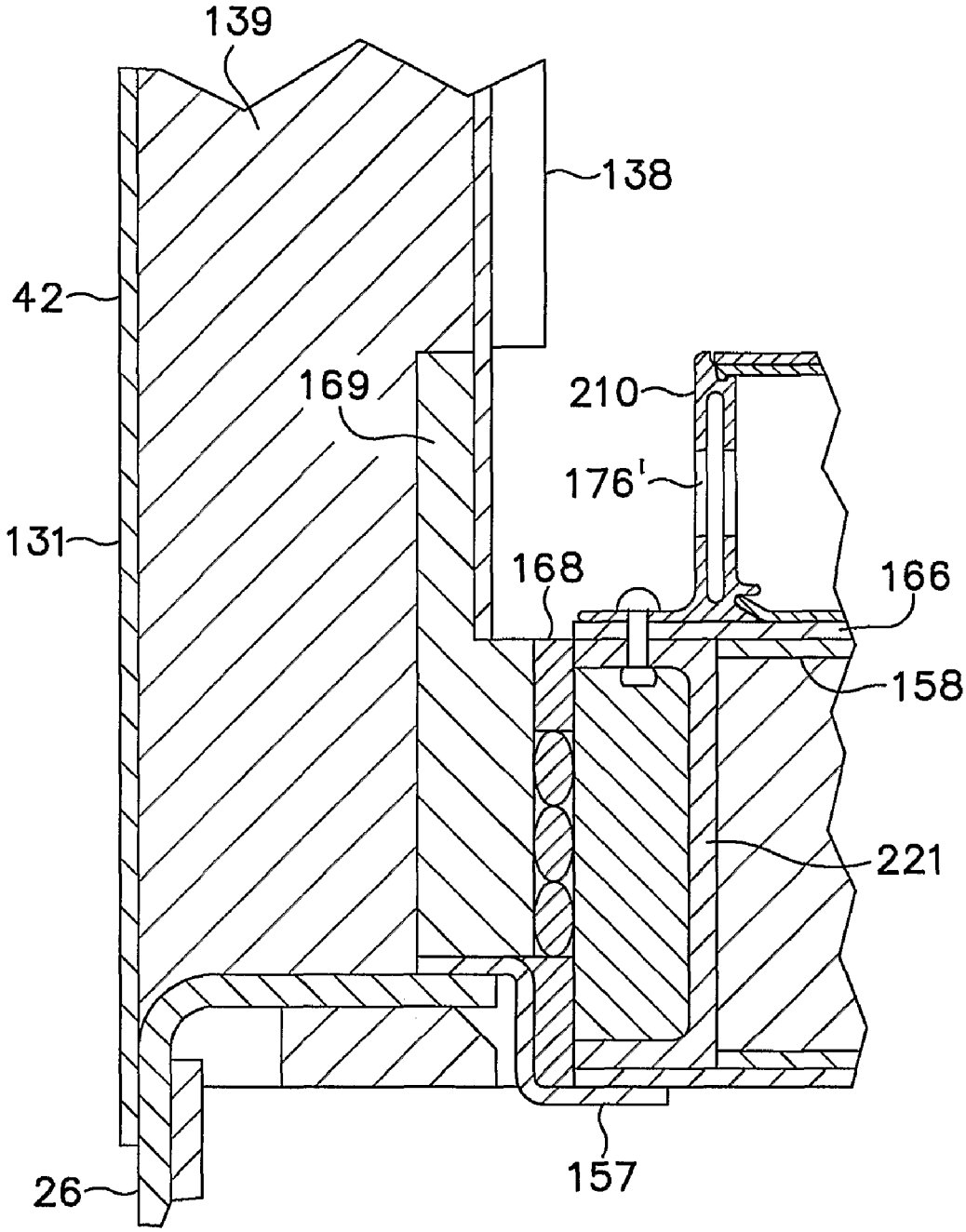
FIG. 11*b* is a detail view at an enlarged scale of a portion of FIG. 11*a*, showing an area of intersection of a subfloor portion with a side wall of the car.

As may be seen in FIGS. 11*a* and 12, the floor 40, resting atop the subfloor 38, includes a top plate 152 resting on the tubular support structure 150 of weight bearing support elements defining parallel tubes 172 extending longitudinally along the subfloor 38 and functioning as the passageways 100 for flow of air from the "B" end of the car 20 toward the "A" end.

A narrow channel 174 extends longitudinally along each side of the floor 40 at the base of the adjacent side wall 42, and the floor 40 includes sets of holes 176 aligned with each other and extending laterally inward about one-third the width of the floor 40, toward the central longitudinal axis of the car and communicating between adjacent passageways 100. The sets of holes 176 are spaced apart along the length 141 of the car at regular intervals 178, of, for example, one foot (30.5 cm), allowing air which has flowed downward within the cargo space 53 from the upper plenum 52 into the channel 174 to pass laterally inward into the parallel tubes 172 to be carried away longitudinally of the car body from the "B" end toward the "A" end of the car.

The refrigeration unit return air intake plenum 80 is connected to the floor 40 at the "A" end of the car body to carry the air upward from the floor 40 and thus back into the intake opening 82 in refrigeration unit 64. The floor 40 thus plays an integral part in forming the path for circulation of the air to maintain the desired temperature within the cargo space 53 and thus to protect the cargo carried within the car.

The tubular support structure 150 of the floor 40 is preferably constructed as a group of extruded aluminum alloy segments 180, each preferably including a pair of complete tubes 182, 184 and a pair of horizontal arms 186, 188 extending laterally from the tube 184, one at the top and one at the bottom of the extruded segment 180. The segments 180 could also be designed to have the arms extending in opposite directions away from the tubes 182, 184, or to have only a single complete tube, or more than the two complete tubes 182, 184 of the segment 180 as shown herein.

Each segment 180 thus includes three upstanding parallel load bearing side wall members 190, 192, 194 extending between and interconnecting a generally planar bottom member 196 with a generally planar top member 198 that is parallel with the bottom member. Each segment 180 may have a height of about 3 inches (76 cm), with each wall member 190, 192, 194 having a thickness of 3/16 (0.48 cm), and the top and bottom members each having a thickness of about 1/8 inch (0.32 cm), for a floor 40 designed to carry a loading of 60,000 lb per lift truck axle. The tube side wall members 190, 192, 194 are interconnected with the top and bottom members 196, 198 in smoothly radiused connection zones, making each parallel tube segment a rigid, strong structure, in which each of the upright side wall members 190, 192, 194 is a weight bearing member capable of transmitting forces between the top and bottom members 196, 198 and capable of withstanding lateral components of forces acting on the floor structure 40.

The segments 180 are designed to interlock with each other when properly placed alongside each other, so that the segments 180 lying parallel with each other can be securely integrated into a single unified floor 40. This is preferably accomplished by providing a groove 200 along an upper shoulder of each segment 180, adjacent an outer tube side wall 190, and by providing a flange 202 having a sloping outer surface, extending out from the bottom of the same tube side wall 190. At the opposite side, shown at the left of each segment in FIG. 12, the upper horizontal arm 186, extending parallel with and as an extension of the top member 198, includes a downwardly projecting rib 204 that fits interlockingly into the groove 200.

The lower horizontal arm 188 extends a slightly smaller distance away from the adjacent tube side wall 194 than does the upper arm 186, and an upwardly sloping lip 206 is provided as the outer margin of the lower horizontal arm 188. The lip 206 fits snugly against the sloping outer surface of the flange 202 of an adjacent segment 180 when the rib is engaged with the groove of that adjacent segment 180 and the two adjacent segments are both supported on a planar surface such as the top panel 166 of the subfloor 38. As shown in FIG. 11, a number, for example four, of the parallel floor segments 180 having holes 176 through their tube side walls 190, 192, 194 are preferably aligned with one another, with the holes 176 aligned with one another along each lateral side of the floor. Air flowing through the tubes 172 of those segments 180 toward the "A" end can draw more air into the tubes 172, by Venturi action, from the channels 174 along the sides of the floor 40.

Other segments 180, for example six segments in the middle of the width of the floor 40, are closed; that is, they have no holes 176 through the tube side wall members 190, 192, 194, and each tube 172 of those parallel segments 180 forms a closed path extending from the conduit 98 at the "B" end of the car 20 to the "A" end and thence into the return air plenum 80 leading to the supply air intake 82 of the refrigeration unit 64.

Extending along the outermost elongate segment 180 along each longitudinally extending side margin of the floor 40 is a respective flanged hold-down member 208 or 210, which may also be of extruded aluminum. A first, or right side hold-down member 208 corresponds to and mates with the tube side wall 190 on the closed side of a tubular segment 180, while the other hold-down member 210 is of a different form, in order to mate appropriately with the two horizontal arms 186, 188 extending laterally from the side of a segment 180 at the opposite, or left side of the floor 40, as shown in FIGS. 11 and 12. A first, or right side hold-down member 208 thus includes a short laterally extending arm 212 with a downwardly extending rib 214, as well as a downwardly facing sloped surface 216, near the bottom end of its upright portion, that fits matingly against the sloping outer surface of the flange 202 at the bottom of the tube side wall 190. An adjoining horizontally outwardly extending fastening flange 218 that can be fastened to the subfloor 38 on which the floor is supported, using suitable mechanical fasteners, such as blind Huck™ fasteners 220 spaced appropriately apart along the length of the floor 40 and extending through the flange 218, the top panel 166, and the top flange of the adjacent support channel 221, shown in FIGS. 11*a* and 11*b*. The channel 221 may be of fiber reinforced plastic filled with insulating foam and closes off the outboard ends of the transverse tubes 158.

At the opposite, or left, side of the floor 40 as shown in FIG. 12, a second, or left side, extruded hold-down member 210 serves both as a hold-down and as a weight bearing closure member for the segment 180 along which it is located. The hold-down member 210 in a preferred embodiment includes a pair of parallel upright members each similar in thickness to one of the tube side walls 190, 192, 194. At a top end the left side hold-down member 210 includes a groove 220 to receive the downwardly facing rib 204 of the top horizontal arm 186 of an adjacent tubular floor segment 180. An inner side of a base portion of the hold-down member 210 has a laterally extending rib 222 above an inner flange 224 with a sloping outer face similar to the face of the flange 202 on each segment 180. The rib 222 and the sloping face of the inner flange 224 together define a groove for receiving the upwardly sloping lip 206 of the bottom horizontal arm 188 of the adjacent tubular floor segment 180. A wider, outwardly extending fastening flange 226 extends laterally away from the base and serves to receive fasteners 220 to attach the left hold-down unit 210 to the subfloor preferably in the same fashion as the fastening flange 218. Holes 176' in the hold-down members 208, 210 are aligned with the holes 176 in the tube side walls 190, 192, 194 of the adjacent floor segments 180.

Atop the assembled group of tubular segments 180 and preferably seated in notches 228 in upper margins of the hold-down members 208, 210 are an array of top plate members 152, preferably of metal such as aluminum plate embossed or rolled with a suitable non-skid surface. Alternatively, a stainless steel top plate 152 with a suitable non-skid surface, although heavier, might be used if preferred because of its better durability. The top plates 152 are also fastened to each of the several segments 180 of the tubular support structure 150 by suitable fasteners such as blind Huck™ fasteners 220 extending through corresponding openings in the floor top plates 152 and the top members 198 of the segments 180, thus fastening together the adjacent tubular segments 180 of the floor 40 as a unified structure.

Figure 13:
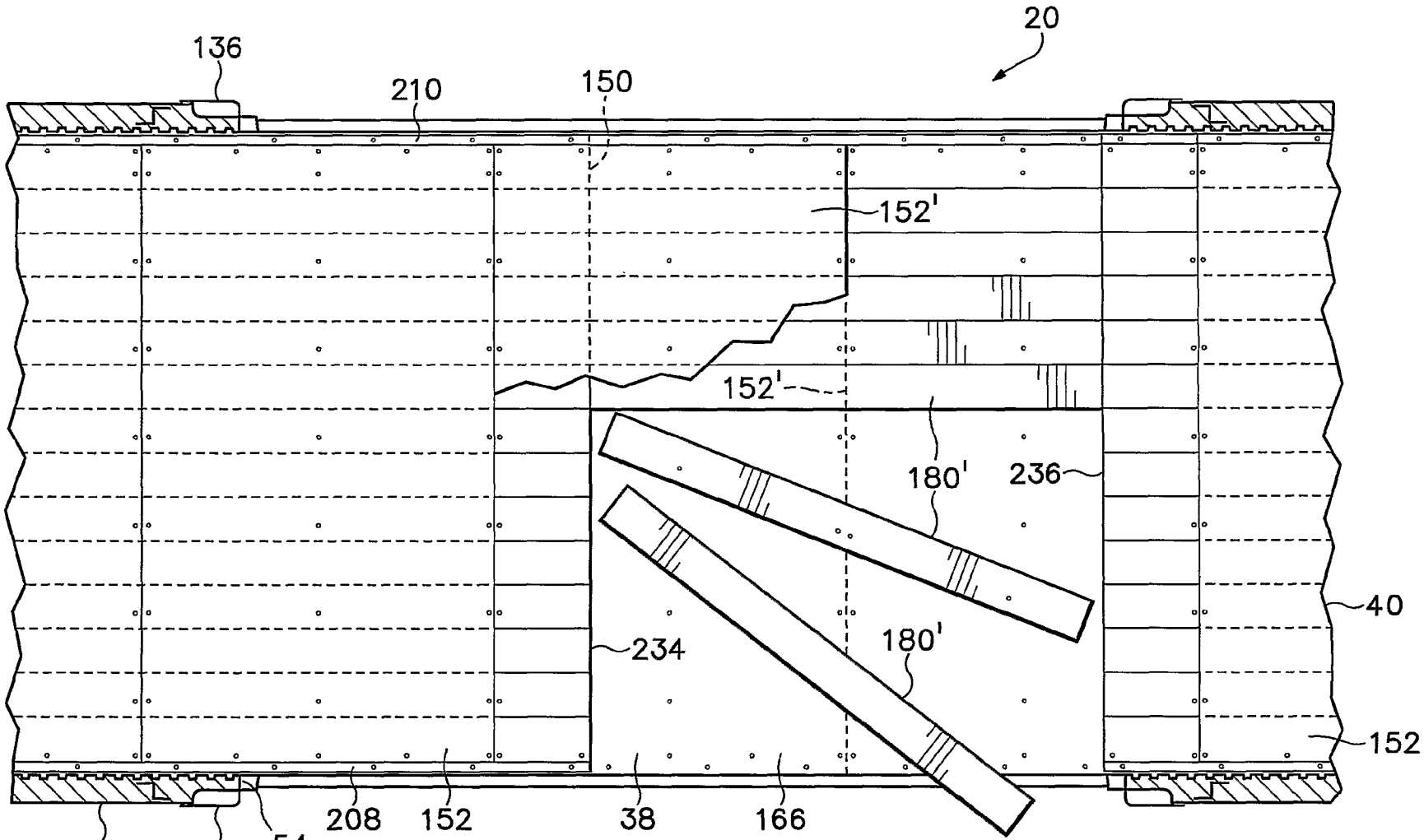
FIG. 13 is a partially cutaway top plan view of a longitudinally central portion of the car, showing provision for gaining access to the tubular structure of the floor for cleaning and repair.

In most portions of the floor 40 adjacent ones of the top plates 152 meet along joint lines spaced apart from the interconnects between adjacent tubular segments 180. Smaller top plate sections 152' are located adjacent the doorways 54 of the car 20, as shown in FIG. 13. Each top plate section 152' is removable, as by grinding away the head of its fasteners 220, and the underlying tubular segments 180 are arranged with respective ends along transversely extending lines 234 and 236 to permit removal and replacement of tubular segments 180' aligned with the doorways 54, where floor damage is most likely to result, and to facilitate cleaning of the tubes 172. Additionally, at each end of the car 20 smaller floor top plates 230 are supported on more widely spaced underlying channels 238 and are held by removable fasteners such as threaded bolts 232, to facilitate cleanout of the tubes 172 of the tubular segments 180 after removal of the segments 180'.

The terms and expressions that have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims that follow.

The invention claimed is:

1. A car body for a temperature-controlled railroad freight car, comprising:

(a) a pair of opposite side walls;

(b) a pair of opposite end walls defining a length of said car body;

(c) a roof interconnected with said side walls and end walls;

(d) a horizontal ceiling adjacent said roof and extending generally horizontally over said length of said car body;

(e) a plenum bottom panel located a predetermined distance beneath said ceiling;

(f) a pair of plenum side members extending downward from said ceiling to said plenum bottom panel, said ceiling, plenum bottom panel, and plenum side members defining a plenum having an inflow end located a short distance from one of said end walls and extending longitudinally along said car body from said inflow end;

(g) an inlet opening defined in one of said end walls of said car body adjacent said inflow end of said plenum and extending lower than said plenum bottom panel at said inflow end; and (h) a diverter extending transversely within said car body adjacent said inflow end of said plenum and having a front face extending at an upward slope from said inlet opening to said plenum, said diverter having a lower margin located at a lower height than said plenum bottom panel and having a transition portion located adjacent said inflow end of said plenum, and said transition portion of said diverter including a shoulder and an inner margin portion extending from said shoulder into said plenum and sloping gently downwardly away from said shoulder so as to direct a flow of air from said inlet opening in said end wall to enter said inflow end of said plenum smoothly and to flow smoothly along said plenum.

2. The combination of claim 1 including an upper deflector panel having a concave surface facing downward and into said plenum.

3. The combination of claim 2 wherein said upper deflector interconnects said end wall with said ceiling adjacent said inlet opening and above said plenum bottom panel.

4. The combination of claim 2 wherein said diverter and upper deflector panel form a convergent-divergent nozzle extending from a location adjacent said inlet opening and leading into said inflow end of said plenum.

5. The combination of claim 1 wherein said plenum bottom panel includes a plurality of interconnected subpanels.

6. The combination of claim 1 wherein a part of said plenum bottom panel spaced apart from said inflow end is perforated so as to distribute air from said plenum into a cargo space within said car body along a length of said cargo space when a flow of air is introduced into said plenum only through said inflow end thereof.

7. The combination of claim 1 wherein said freight car includes a transverse horizontal support member located inwardly adjacent said end wall and said diverter includes a bottom flange fastened to said horizontal support member and extending horizontally and away from said end wall adjacent said inlet opening.

* * * * *